United States Patent [19]
Frye
[11] 4,250,868
[45] Feb. 17, 1981

[54] DRAFT INDUCER/DAMPER SYSTEMS

[76] Inventor: Filmore O. Frye, 42 W. Blaine St., McAdoo, Pa. 18237

[21] Appl. No.: 930,931

[22] Filed: Aug. 4, 1978

[51] Int. Cl.³ ..... F24B 7/00; F24F 13/00
[52] U.S. Cl. ..... 126/121; 126/120; 236/1 G; 236/DIG. 9; 98/43 R
[58] Field of Search ..... 126/120, 121, 312, 299 R, 126/299 D, 131; 110/162; 431/20; 236/45, DIG. 9, 1 G; 98/115 LH, 43 R, 72; 237/1 R, 51

[56] References Cited

U.S. PATENT DOCUMENTS

| | | | |
|---|---|---|---|
| 2,447,405 | 8/1948 | Gabar | 126/120 X |
| 3,211,080 | 10/1965 | Rader | 98/72 |
| 3,782,303 | 1/1974 | Pfister et al. | 110/162 |
| 4,049,196 | 9/1977 | Bergami, Jr. et al. | 126/121 X |

FOREIGN PATENT DOCUMENTS

| | | | |
|---|---|---|---|
| 2518750 | 11/1976 | Fed. Rep. of Germany | 126/299 D |
| 1095644 | 12/1967 | United Kingdom | 126/121 |

*Primary Examiner*—Samuel Scott
*Assistant Examiner*—Lee E. Barrett
*Attorney, Agent, or Firm*—Ernest G. Szoke

[57] ABSTRACT

A control system adapted to be secured to a solid fuel burner, such as a fireplace or a stove, to create and regulate forced fluid heat exchange and forced draft in the burner. The system comprises an electrical draft inducer/damper mounted in the burner flue, a fluid heat exchanger mounted over the burner firebox, and a control apparatus capable of deactivating the draft inducer/damper and the heat exchanger, automatically damping the flue, when combustion in the burner subsides. The control system, including the draft inducer/damper and heat exchanger, may be incorporated with a solid fuel burner, thus comprising a heating system.

3 Claims, 5 Drawing Figures

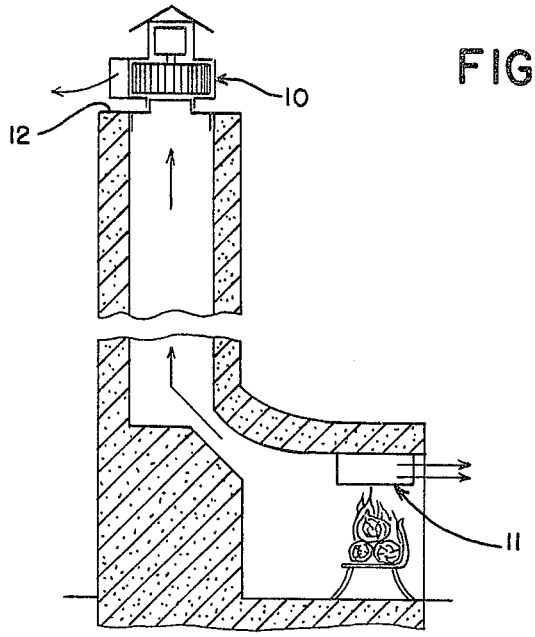
FIG. 1
FIG. 2
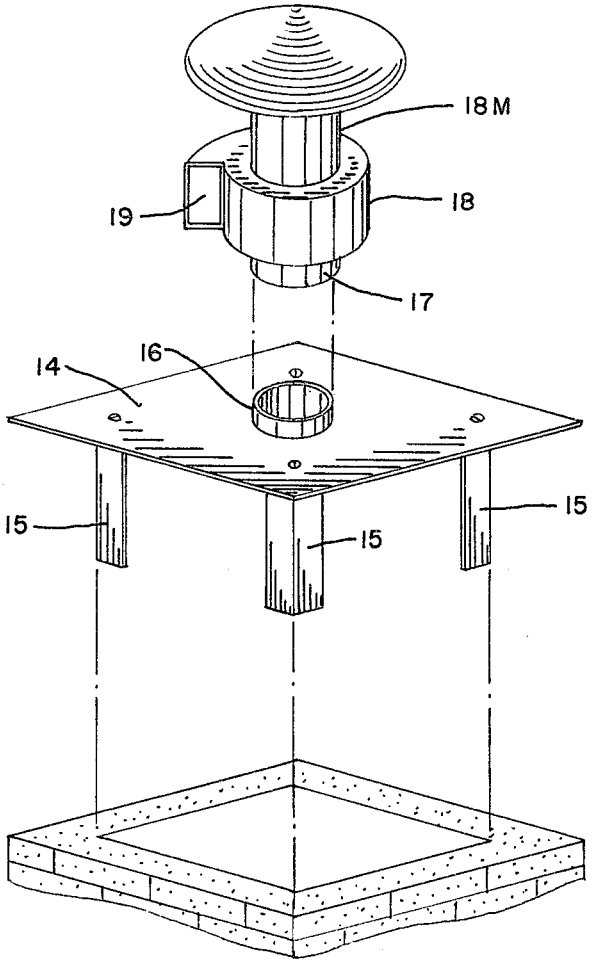

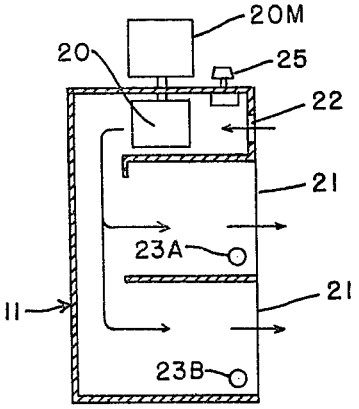
FIG. 3
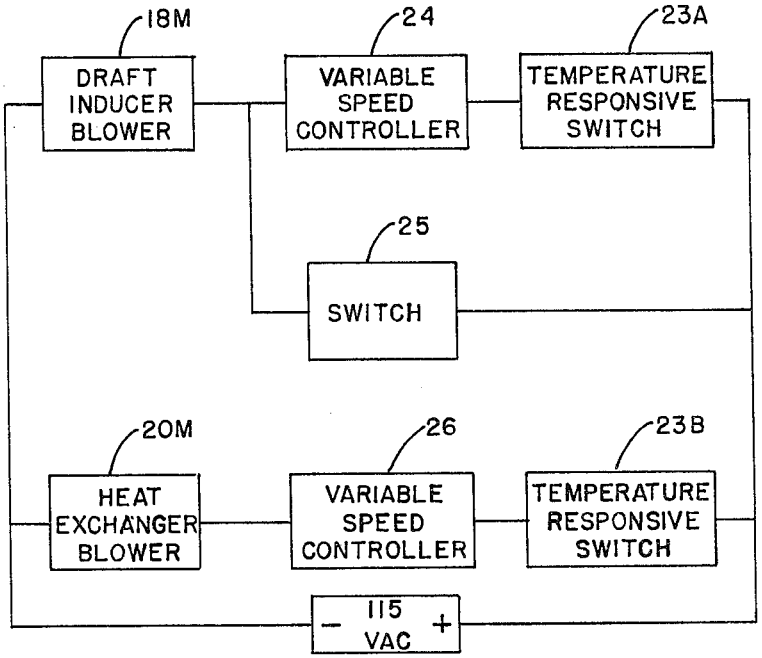
FIG. 4
FIG. 5
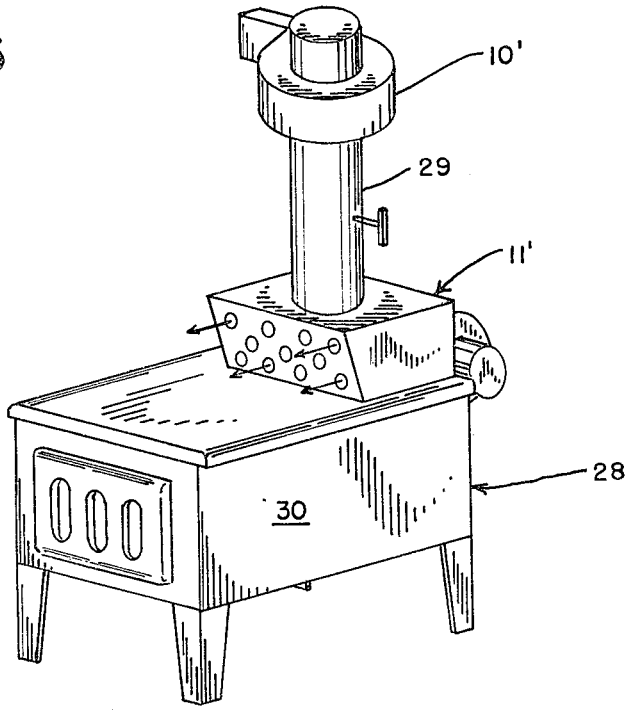

DRAFT INDUCER/DAMPER SYSTEMS

BACKGROUND OF THE INVENTION

This invention relates to heating apparatus and, more particularly, to a semiautomatically controlled forced draft and forced fluid heat exchange system for a solid fuel burner. The invention is particularly well suited for use with a residential fireplace and will be described principally with reference thereto; however, it is capable of broader application and could be used on many types of solid fuel burners such as wood and coal stoves.

Fireplaces and stoves have been used to provide residential heat for many years. Although once the predominant form of heating and cooking, these devices declined in importance as central home heating systems and gas and electric stoves became the norm. During this period, until only recently, the traditional fireplace and stove were built more for appearance than function. They were no longer necessities, only aesthetic fixtures intended for occasional use. Consequently, there was little incentive to improve upon the inefficiencies of the traditional installations.

In recent years, however, the rising cost of fossil fuels and the energy consciousness of this country have renewed interest in the fireplace and stove as sources of heat. Many home owners, hoping to reduce their consumption of increasingly expensive fossil fuels, attempt to rely upon their existing fireplaces and stoves as supplemental sources of heat only to find them grossly inefficient. This invention permits a homeowner to substantially increase the efficiency of his existing fireplace or stove, thereby rendering it of practical value without destroying its aesthetic value. In addition, the invention may be incorporated into new installations with comparable results.

One of the most important factors affecting fireplace efficiency is the method of discharging the combustion products. In order to function efficiently, a fireplace requires a substantial draft. In typical fireplaces, sufficient draft is achieved by providing a flue having a large cross sectional area. To prevent the loss of heated room air when the fireplace is not in use, a manual damper is used. A problem with this system is that unless the damper is manually closed after the fire dies out, heated room air is drawn up the flue. Another disadvantage of the traditional system is that even with proper draft, most of the heat generated by the fireplace goes up the flue with the exhaust gases.

There have been many attempts to improve upon these inefficiencies. Heat exchangers of various types have been mounted in the fireplace and blowers have been placed in the flue to improve draft conditions. Each of these efforts has been unsatisfactory for one or more reasons: they are complex, expensive, inconvenient to operate, difficult to install, or incomplete in meeting the problems. For example, the forced draft blower disclosed in U.S. Pat. No. 3,782,303 to Pfister, although of some benefit in terms of creating a substantial draft through a burner, suffers from the disadvantages of manual control. As a result, the inefficiencies caused by improperly modulated draft, such as excessive heated room air loss, persist.

OBJECTS OF THE INVENTION

Accordingly, it is an object of this invention to provide a controlled forced draft, forced fluid heat exchange system to substantially increase the efficiency of an existing fireplace or stove.

Another object of this invention is to provide a system of the type described which is convenient to operate.

Another object of this invention is to provide a system of the type described which is inexpensive, simple in construction, and easily installed in existing fireplaces and stoves.

Another object of this invention is to provide a system which automatically shuts down at a predetermined rate of combustion in the fireplace or stove.

Other objects and advantages will become apparent from the following specification and drawings.

BRIEF DESCRIPTION OF THE DRAWINGS

FIG. 1 is a somewhat diagrammatic view showing a draft inducer/damper and forced air heat exchanger adapted to a fireplace;

FIG. 2 is an enlarged view of the draft inducer/damper and chimney mounting apparatus;

FIG. 3 is an enlarged view of a forced air heat exchanger;

FIG. 4 is a diagrammatic view of the draft inducer/damper and forced air heat exchanger control circuit; and FIG. 5 is a similar system adapted to a stove.

DESCRIPTION OF THE PREFERRED EMBODIMENT

Referring to the drawings, which illustrate a preferred embodiment of the invention only, FIG. 1 shows the draft inducer/damper 10 and air heat exchanger 11 mounted in a typical fireplace. The draft inducer/damper is mounted near the upper end of the existing flue. The mounting apparatus 12 of the draft inducer constricts the cross sectional area of the flue so as to direct all of the exhaust through the draft inducer. The heat exchanger is mounted at the top of the firebox so as to be heated by the fire and escaping combustion products. The control apparatus for the draft inducer and heat exchanger (not shown in FIG. 1) may be mounted in a convenient location near the fireplace.

FIG. 2 is a more detailed illustration of the draft inducer/damper and mounting apparatus. A base plate 14 is provided of sufficient size to completely cover the upper end of standard fireplace flues. In order to secure the base plate to the flue, several legs 15 are attached so as to frictionally engage the inside of the flue. Any overhang by the base plate over the outside of the flue may be trimmed off or folded down over the sides of the flue and secured with a steel band or the like (not shown). A particular advantage of the described mounting apparatus is that no drilling or permanent alteration to the flue is needed. This would be especially important when the invention is installed in a fireplace in an older home in which the flue may be somewhat deteriorated or weakened. Also, the frictional mounting apparatus may be easily removed to permit repair or relocation of the draft inducer.

In the center of the base plate 14, a hole is provided to which a tube 16 is attached. The tube 16 is adapted to communicate with and be received in the intake opening 17 of a blower 18, such as an electrically driven squirrel cage blower. Thus, when fully mounted, the base plate reduces the cross sectional area of the flue to the size of the blower intake opening and ultimately to the size of the blower outlet. When the blower is operating, it draws the exhaust gases from the burner up the flue, through the reduced base plate tube, and expels them into the atmosphere through outlet 19. When the blower is idle, however, the reduced flue opening provided by the base plate and, ultimately, the blower outlet, substantially restricts the natural convective flow of exhaust, thus automatically functioning as a damper.

FIG. 3 is a somewhat diagrammatic illustration of the heat exchanger 11. A blower 20 draws air from the room through one or more intakes, forces it through the body of the exchanger which has been heated by the burner, and returns it to the room through one or more discharge openings 21. Alternatively, the intake 22 may be adapted to draw fresh air from outside the building instead of from the heated room.

One or more temperature-responsive switches or sensors 23*a*–23*b* are preferably mounted near the heated air discharges 21 so as to sense the temperature of the heated air or of the heat exchanger housing. These temperature-responsive sensors will be described in conjunction with the draft inducer/damper and heat exchanger control apparatus.

FIG. 4 is a diagrammatic view of the draft inducer/-damper and air heat exchanger control apparatus and associated electrical circuit. The draft inducer blower and heat exchanger blower are located in parallel in the energizing circuit. A variable speed controller 24 and a temperature-responsive switch 23*a* are in series with the draft inducer blower motor 18*m*. A manually actuable switch 25 is in parallel with the variable speed controller 24 and the temperature-responsive switch 23*a* series combination. A variable speed controller 26 and a temperature-responsive switch 23*b* are in series with the heat exchanger blower motor 20*m*. The sensors for the temperature-responsive switches are adapted to sense the combustion conditions in the burner. To this end, they are adapted to close their respective switches at, and open them below, a predetermined temperature representative of the rate of combustion in the burner. The sensors are placed so that they detect the temperature of parts or air heated by the fire, and can be placed, for example, in the firebox or the heat exchanger. However, a particularly advantageous location for the sensors is in the discharge opening of the heat exchanger so as to sense the temperature of the discharged heated air.

The temperature of the heated air discharge closely corresponds to the intensity of combustion in the burner, yet is substantially lower than the actual temperature in the firebox. Thus, the combustion conditions in the burner can be monitored by reference to fluctuations in relatively low temperatures, permitting the use of less sophisticated, less expensive sensors. Also, since the sensors are subjected to a norrower range of temperature, their service lives are prolonged.

It should be noted that the various circuit elements are conventional units and no detailed explanation thereof is believed necessary.

The operation of the apparatus described will now be explained. Before starting a fire in the fireplace or stove, switch 25 is manually closed, activating the draft inducer blower motor 18*m* which then operates at substantially its full design speed. This ensures a strong draft for starting the fire quickly. A fire of the desired size is built. After the fire has raised the heat exchanger air discharge temperature sufficiently to cause the temperature-responsive switches 23*a* and 23*b* to close, switch 25 can be manually opened. The variable speed controllers 24 and 26 are then adjusted to provide the desired draft through the fireplace or stove and forced air flow through the heat exchanger respectively. The system is now automatic. As long as the fire is sufficiently intense to heat the forced air flow from the heat exchanger to above the predetermined temperatures, the blowers continue to create a draft and heated air flow. When the fire can no longer heat the forced air flow above the predetermined limit temperature of temperature-responsive switch 23*b*, the switch opens and shuts off the heat exchanger blower. Similarly, when the temperature of the heated air discharge of the heat exchanger drops below the predetermined limit temperature of temperature-responsive switch 23*a*, the switch opens and shuts off the draft inducer blower. At this point, the small draft inducer blower outlet, through which the combustion products where drawn, still permits the reduced exhaust flow and residual gases to escape, yet substantially retards the loss of heated room air. Thus, where evening heating is desired, a fire can be built and, without attention, the forced air heat exchanger and the draft inducer will automatically shut off when no longer needed. Since the restricted flue opening created by the deactivated draft inducer will act as a damper, the loss of heated room air, a major cause of poor fireplace efficiency, will be substantially reduced. In addition to the convenience of automatic operation, the controls are likely to be more accurate in the timing of shutdown than a typical user who would be guessing as to the best time to deactivate the blowers.

The temperature-responsive switches 23*a* and 23*b* can be adjustable, and thus automatically shut off the draft inducer blower and the heat exchanger blower, at desired temperatures, or are preset for optimum values at the factory.

It has been found desirable to have the switch-off temperature for the switch 23*b* somewhat higher than that of switch 23*a* so that the heat exchanger blower ceases to function while the inducer/damper blower motor continues to operate. This is desirable to avoid the build-up of undesirable gases, for example carbon monoxide, within the burner.

For fireplace units with the switches 23*a* and 23*b* located in the air heat exchanger, along the lines as illustrated in FIG. 3, and for wood stove units, a temperature differential of approximately 14° C. (20° F.) has been found to yield desirable results.

FIG. 5 illustrates the draft inducer and heat exchanger mounted on a stove 28. The draft inducer 10' is mounted near the upper end of the vertical flue duct 29. The heat exchanger 11' is mounted above the firebox 30 in order to be heated by the fire.

In this embodiment, the temperature-responsive switches 23*a* and 23*b* (FIG. 4) are preferably mounted adjacent the outlet ends of the heat exchanger tubes.

Adapted to a stove, the invention possesses several advantages in addition to those attendant to installation in a fireplace. The draft inducer will permit the use of a stove without a chimney or a long vertical flue normally necessary for proper draft. Also, the draft inducer can be used to create sufficient draft in horizontal flues up to a distance of approximately sixty feet. This can simplify installation of the stove, as the flue can be diverted horizontally, for example through an outside wall.

Finally, several heat exchangers can be stacked above the stove firebox to increase its heating efficiency even further.

The foregoing disclosure illustrates the manner in which the invention realizes the objects and advantages set forth above, and is intended to represent a preferred form of the invention rather than limit it. The invention is to be accorded the full scope of the appended claims.

I claim:

1. A residential heating system comprising:

a fireplace, a flue having an inlet end connected to the fireplace to receive the products of combustion produced in said fireplace and an exhaust end remote from the inlet end for discharging the products of combustion, a hot air heat exchanger associated with, and heated by, the fireplace, a first electrically operated blower means located in the exhaust end of the flue to create and maintain a forced draft through said fireplace, a second electrically operated blower means for creating and maintaining forced air through said heat exchanger; and, an electrical control circuit, including (a) a manually actuated switch for activating said first blower means, (b) a temperature responsive switch electrically connected to a first temperature sensing device located in said heat exchanger for deactivating said first blower means when the temperature in the heat exchanger drops below a first pre-determined temperature; and, (c) a second temperature responsive switch electrically connected to a second temperature sensing device located in the heat exchanger for activating and deactivating said second blower means in accordance with pre-determined temperatures in the heat exchanger.

2. A heating system according to claim 1 wherein the hot air heat exchanger is located inside the fireplace to circulate air from inside the residence through the fireplace.

3. A heating system according to claim 1 or 2 wherein the first temperature sensitive switch is set to deactivate the forced draft blower at a temperature below the temperature at which the second temperature responsive means deactivates the heat exchanger blower.

* * * * *